United States Patent [19]

Haynes

[11] 4,437,363

[45] Mar. 20, 1984

[54] DUAL CAMMING ACTION JAW ASSEMBLY AND POWER TONG

[75] Inventor: Charles W. Haynes, Spring, Tex.

[73] Assignee: Joy Manufacturing Company, Pittsburgh, Pa.

[21] Appl. No.: 278,293

[22] Filed: Jun. 29, 1981

[51] Int. Cl.[3] ..... B25B 17/00

[52] U.S. Cl. ..... 81/57.18; 81/57.2; 81/57.21

[58] Field of Search ..... 81/57.15, 57.16, 57.17, 81/57.18, 57.19, 57.20, 57.21

[56] References Cited

U.S. PATENT DOCUMENTS

| | | | |
|---|---|---|---|
| 1,031,261 | 7/1912 | Helm | 81/57.15 |
| 4,084,453 | 4/1978 | Eckel | 81/57.18 |
| 4,192,206 | 3/1980 | Schulze-Beckinghausen | 81/57.18 |
| 4,250,773 | 2/1981 | Haynes et al. | 81/57.21 |

*Primary Examiner*—James L. Jones, Jr.

*Attorney, Agent, or Firm*—Ernest E. Helms; Edward L. Levine

[57] ABSTRACT

A rotary tong for use in well drilling operations to make up and break out drill strings or similar axially elongated objects which has a secondary camming action provided by the jaw assembly. By use of the inventive jaw assembly a secondary camming action is produced which reduces the cam angle of the primary camming function. The reduced cam angle gives greater gripping force thereby reducing slippage. The secondary camming function also allows the jaw to be used for a greater variety of drill string sizes thereby reducing the need to change tongs or jaw elements when drill string sizes change.

25 Claims, 7 Drawing Figures

DUAL CAMMING ACTION JAW ASSEMBLY AND POWER TONG

BACKGROUND OF THE INVENTION

In well drilling operations, a power tong is used to grip and rotate lengths of pipes, rods or other axially elongated bodies for the purpose of connecting together or disconnecting threaded end sections of such bodies. In the usual case, the tong is of the open-headed type having a housing with a central opening and an outward-open passageway or throat which permit the tong to be positioned around a pipe joint without the necessity of lowering the tong over a length of pipe.

When the tong is operated, pipe-gripping means (often referred to as jaws) are caused to revolve around the aforesaid central opening, these jaws causing the pipe or axially elongated object being gripped thereby to axially rotate. Looking at the gripping action of the jaws in more detail, most tongs accomplish the grip by means of a rotor which forces a cam which is attached to the jaw frame to lock into position against a cam surface along the inside surface of the rotor. The action of the cam against the cam surface forces the jaw radially or pivotally radially inward causing a die assembly to engage the pipe. The smaller the cam angle the greater the gripping force produced; however, reduced cam angles can often lead to forces which will deform the pipe. In prior tongs, many attempts to reduce the cam angle have failed because it was not possible to effectively limit the camming angle reduction. Since the range of variance of the cam angle which can be practically used is small, jaw assemblies have very limited ranges of pipe radii that they can be used upon. Accordingly, an object of the present invention is to provide a jaw assembly and a power tong incorporating the same with a primary and a secondary camming function which permits a reduced angle for the primary camming function; thereby increasing grip and decreasing slippage.

Another object of this invention is to provide a jaw assembly and a power tong incorporating the same which allows the cam angle of the primary camming function to be reduced, however, limiting the reduction and preventing damage to pipe or similar axially elongated objects.

Yet another object of this invention is to provide a jaw assembly and a power tong incorporating the same which allows the jaw assembly to be used for a greater range of pipes or similar cylindrical objects, therefore saving time and money from unneeded changes in equipment mandated by different pipe sizes.

These together with other objects and advantages of the invention will become more apparent upon reading the undergoing specification and claims.

SUMMARY OF THE INVENTION

The jaw assembly provided in accordance with the present invention in a power tong provides a dual camming action by providing a second camming action caused by relative movement between the die assembly and the jaw frame, thereby reducing the primary cam angle and increasing gripping force. The jaw assembly also increases the range of a given pair of jaws in a tong assembly. The inventive jaw assembly and resultant power tong will mainly be described in a preferred embodiment of jaw assemblies with the cam follower being rotatably mounted to the rear of the jaw frame and the jaw frame being pivotally mounted to the drag assembly (sometimes referred to as a drag drum, carrier member, drag plate or plate member), however, this invention also covers a power tong where the jaw frame is slidably mounted in radial interstices of the drag assembly. This new invention may also be used when the cam follower is rigidly or rotatably connected to a lever arm which is pivotally connected to the rear of the jaw frame and the same lever arm is pivotally connected to the drag assembly.

The basic parts of this invention are a jaw frame, a die assembly slidably mounted to the jaw frame and a cam follower means. The die assembly preferably is mounted to the front portion of the jaw frame which is the side closest to the cylindrical object to be rotated, and the cam follower means is preferably connected to the rear portion of the jaw frame. On a rotary power tong the gripping force applied to the pipe is developed by the cam follower cooperating with a cam surface portion of the power tong to impart a primary camming action of the jaw frame into and out of engagement with an axially elongated body. With this invention the jaw of a power tong works as previously described; however, we add to this a second camming action caused by the relative motion between the die assembly and the jaw frame.

The above and other objects and features of the invention will become apparent in the following detailed description of several preferred embodiments of the invention taken in connection with the accompanying drawings which are part of the specification and in which.

Figure 1:
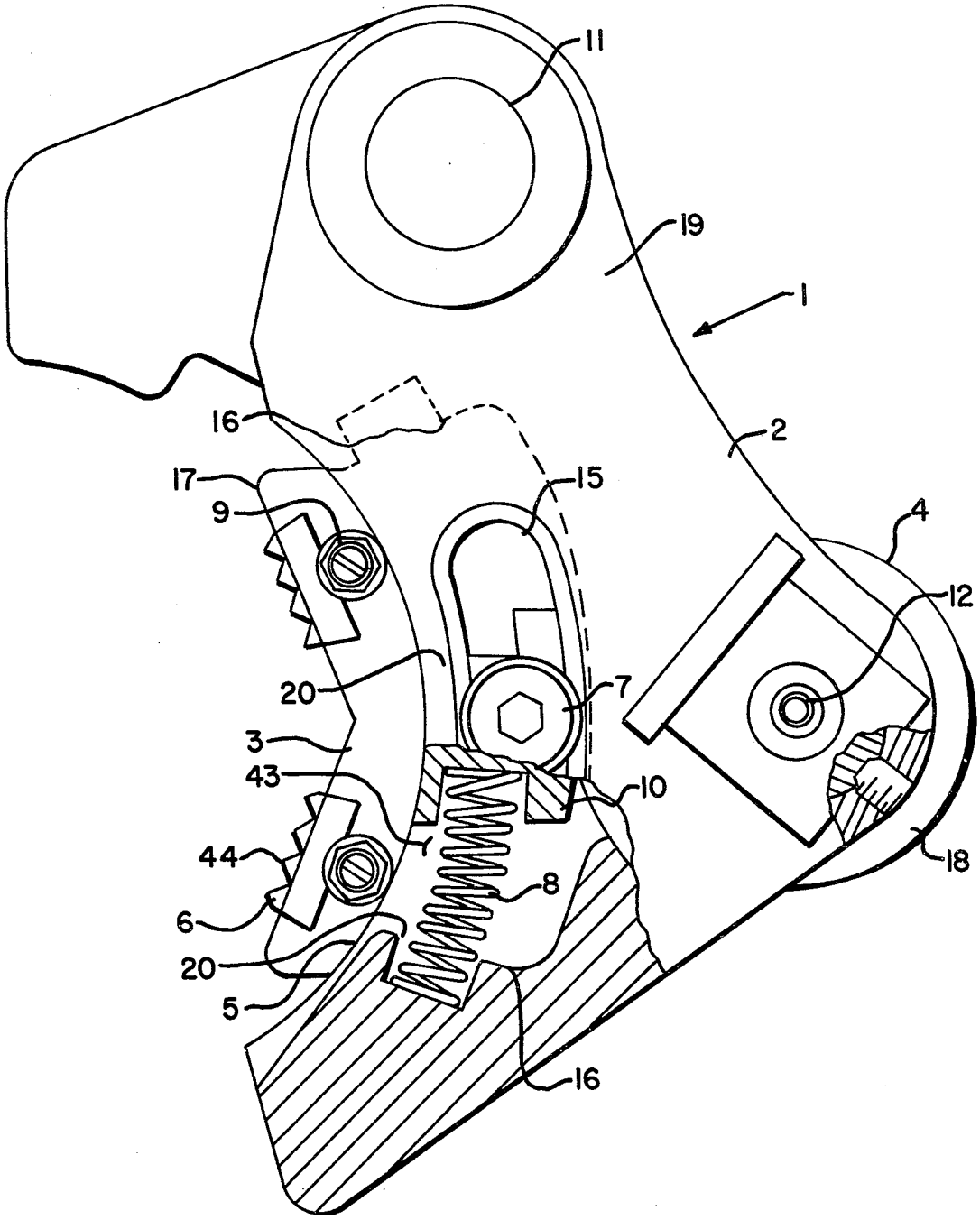
FIG. 1 is a plan view partially in section, of the jaw assembly of one preferred embodiment of the invention.
Figure 6:
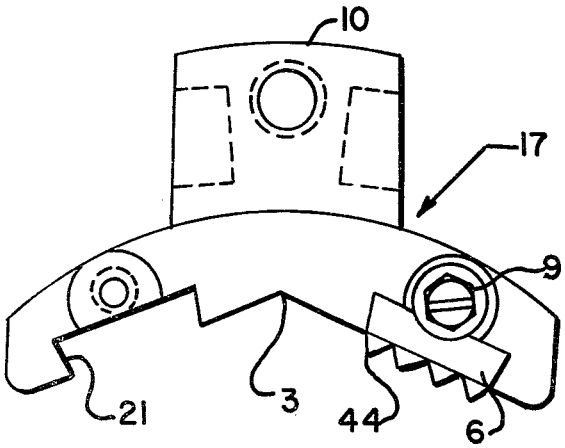
FIG. 6 is a plan view of a die assembly of the instant invention.
Figure 7:
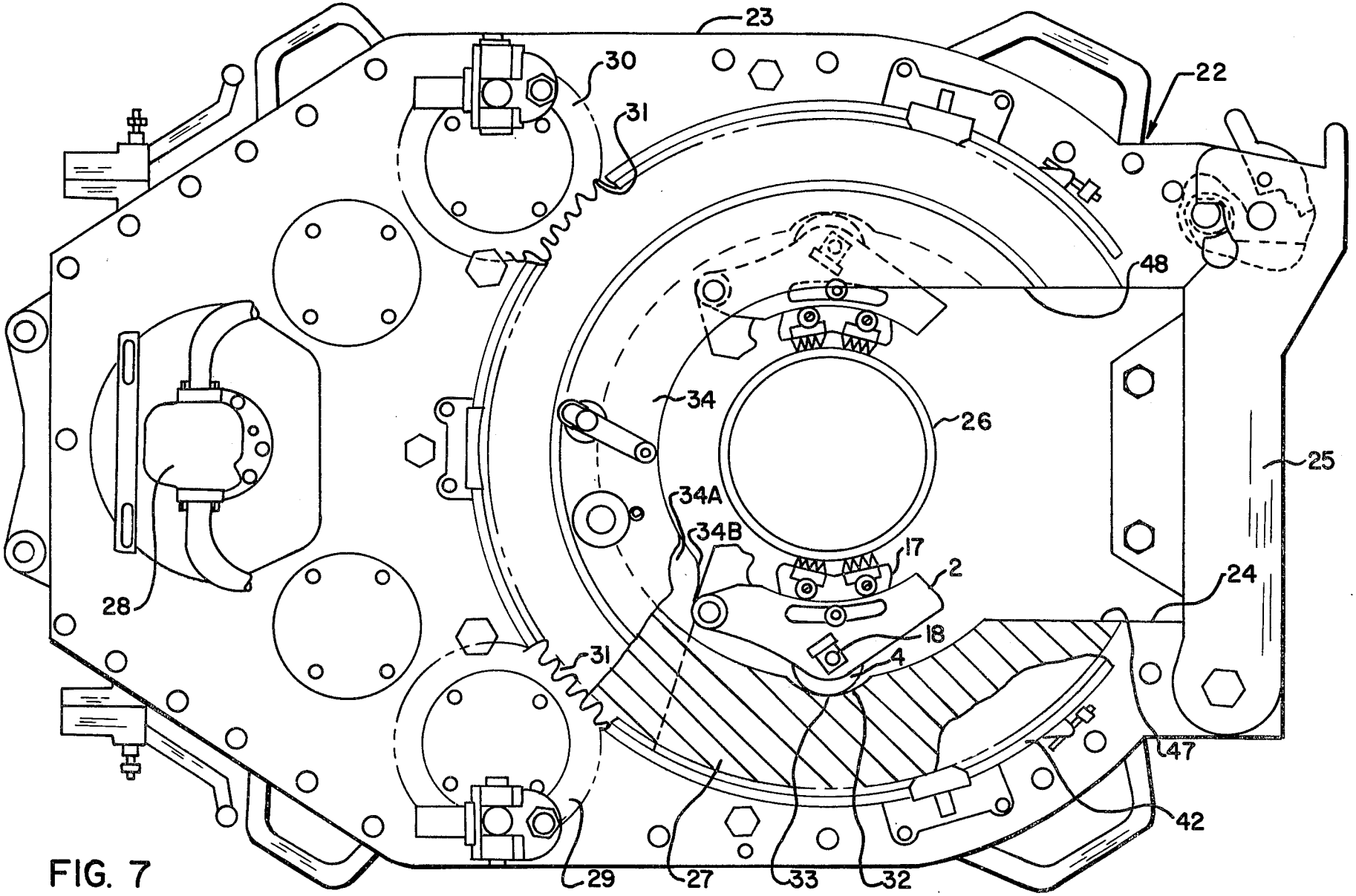
FIG. 7 is a plan view of a tong incorporating a preferred embodiment of the inventive jaw assembly.

With reference now to the drawings with particular attention to FIGS. 1, 6 and 7. FIG. 1 in detail shows construction of the jaw assembly itself. The jaw assembly 1 is mainly comprised of three basic parts. The parts are the jaw frame 2, the die assembly 17, and the cam follower means 18. The front portion of the jaw frame 2 is that portion which is orientated towards the axially elongated body 26 to be rotated. The jaw frame 2 is made up of a main body portion 19 and spaced apart upper and lower side portions 20. The side portions 20 form between themselves a groove 43 which the die assembly 17 mounts within as will later be described. The side portions 20 also have a crescent shaped slot 15 wherein the concave surfaces of the slot are directed towards the axially elongated body 26 to be rotated.

The die assembly 17 mainly comprises three basic parts. The main part of the die assembly 17 is the die holder 3. The die holder 3 is retained within the upper and lower side portions 20 by virtue of a pin 7 which connects with the die holder 3 and is retained within the crescent shaped slot 15. The portion of the die holder 3 which always rides within the groove 43 formed from upper and lower side portions 20 is called the tongue 10. The preferred embodiment has a groove 43 formed by the upper and lower side portions 20. The upper and lower side portions 20 of the preferred embodiment are substantially in the form of a plate and are positioned parallel to each other to form the groove 43; however, the groove 43 could be formed by machining an offset directly on the jaw frame 2 itself or the upper and lower side portions 20 could be made to be converging while the die holder tongue 10 could be made with a taper which fits within the tapered groove 43 formed by the modified upper and lower side portions 20. The second part of the die assembly 17 is the die insert 6 which makes direct contact with the cylindrical or axially elongated body 26. The die inserts 6 in the preferred embodiment fit into a slot 21 made in the die holder 3. The third part of the die assembly 17 is the washer head screw 9 which retains the die insert 6 within the die holder 3. If one desired the die inserts 6 can be eliminated and the die teeth 44 can be machined directly out of the die holder 3, however, die inserts 6 allow the die teeth 44 to be replaced without changing the die holder 3. It is also possible to have detachable die inserts 6 without having the slots 21 formed on the die holder 3.

The die assembly 17 is maintained in a neutral position by a biasing means. For example, FIG. 1 shows a coil spring 8 captured between the jaw frame 2 and the die assembly 17 as the biasing means. In a preferred embodiment two springs 8 are used in order to urge the die assembly 17 to a neutral position from either direction, however, only one is illustrated in FIG. 1.

To limit the relative motion between the die assembly 17 and the die holder 3 stopping means are utilized. Since the stopping means limit relative motion, it also limits the decrease in cam angle therefore preventing damage to the axially elongated body 26. In FIG. 1 the stopping means comprises the tongue 10 making contact with the jaw frame landing 16.

In the preferred embodiment the die assembly 17 is slidably mounted in a circular curvature surface of contact 5. Although other surfaces may work a circular curvature surface of contact 5 will allow continuous line contact between the die assembly 17 and jaw frame 2. The preferred embodiment also has a circular curvature surface of contact 5 with a radius which is smaller than the radius of the axially elongated body 26 to be rotated. The focus of the circular surface of contact 5 is located in such a point that when the jaw assembly 17 is engaged upon the pipe relative motion between the die assembly 17 and the jaw frame 2 generates a camming action which moves the die assembly 17 radially inward with respect to the axially elongated body 26 being gripped during rotation in either rotary direction. As stated before the radius of the circular surface of contact 5 is smaller than the radius of the axially elongated body 26. When the jaw assembly 1 becomes engaged upon the axially elongated body 26 friction between the axially elongated body 26 and the die insert 6 causes the die assembly 17 to become fixed. As the jaw frame 2 continues to move in either rotary direction relative motion between the jaw frame 2 and die assembly 17 forces the die assembly 17 towards the axial center of the cylindrical body 26 to be rotated if the focus of the circular surface of contact 5 is located as described (see also FIGS. 2 and 3). The camming action caused by the relative motion between the die assembly 17 and jaw frame 2 (referred to as the second camming action when the jaw assembly 1 is placed in a tong) decreases the cam angle and increases the grip. Since grip is increased the jaw assembly 1 can be used for a greater range of axially elongated bodies 26.

The third major element of the jaw assembly 1 is the cam follower means 18. The cam follower means of the preferred embodiment is a circular cam surface contact member 4, such as a roller rotatably mounted to the rear portion of the jaw assembly 2.

Although the preferred embodiment has a cam surface contact member 4 which is rotatably mounted a cam surface contact member 4 rigidly mounted may be used and also the cam surface contact member 4 can be noncircular. In FIG. 1 roller pin 12 is used to mount the cam surface contact member 4 to the rear portion of the jaw frame 2.

FIG. 7 shows power tong 22 incorporating the inventive jaw assemblies. The housing 23 has an opening called a throat 24. Covering the throat 24 is a latch 25 which opens to allow the tong 22 to be placed around the axially elongated body 26. The latch 25 is then closed to assure safety during operation. Opposite the latch 25 the housing 23 contains drive means for turning the rotor 27. The drive means may be at any of several types; however, drive means shown in FIG. 7 comprises a hydraulic motor 28 through a gear train (not shown) rotating two pinion gears 29 and 30. The pinion gears 29 and 30 mesh with the gear teeth 31 on the outer periphery of the annular rotor 27. The spacing between the pinion gears 29 and 30 insures that the rotor 27 will continue to rotate whenever an opening or throat 47 of the annular rotor 27 is positioned adjacent one of the pinion gears 29 and 30.

The annular rotor 27 is carried by the housing 23 and is rotatable relative to the housing 23 about an axis generally perpendicular to the opposite sides of the housing 23. On the inner periphery of the rotor 27 on diametrically opposite sides are cam surfaces 32. The cam surfaces 32 may include a neutral surface position 33 allowing the jam assemblies to open outward for insertion of the tong 22 around the axially elongated body 26. The rotor throat 47 can be aligned with the throat 24 of the housing 23.

Figure 4:
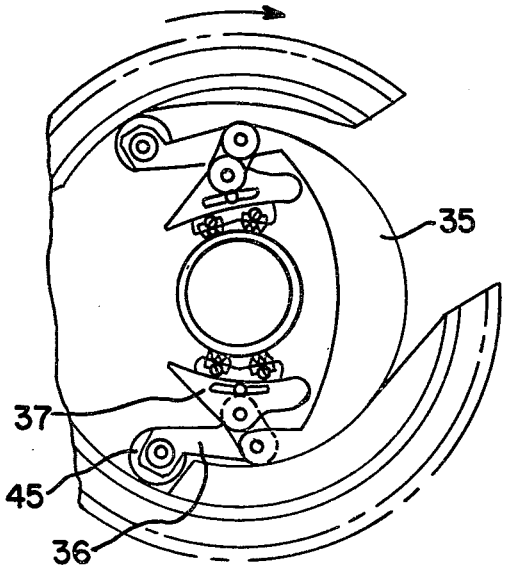
FIG. 4 shows an alternative embodiment of the invention wherein the cam follower means includes a lever arm pivotally connected to the rear portion of the jaw frame.
Figure 5:
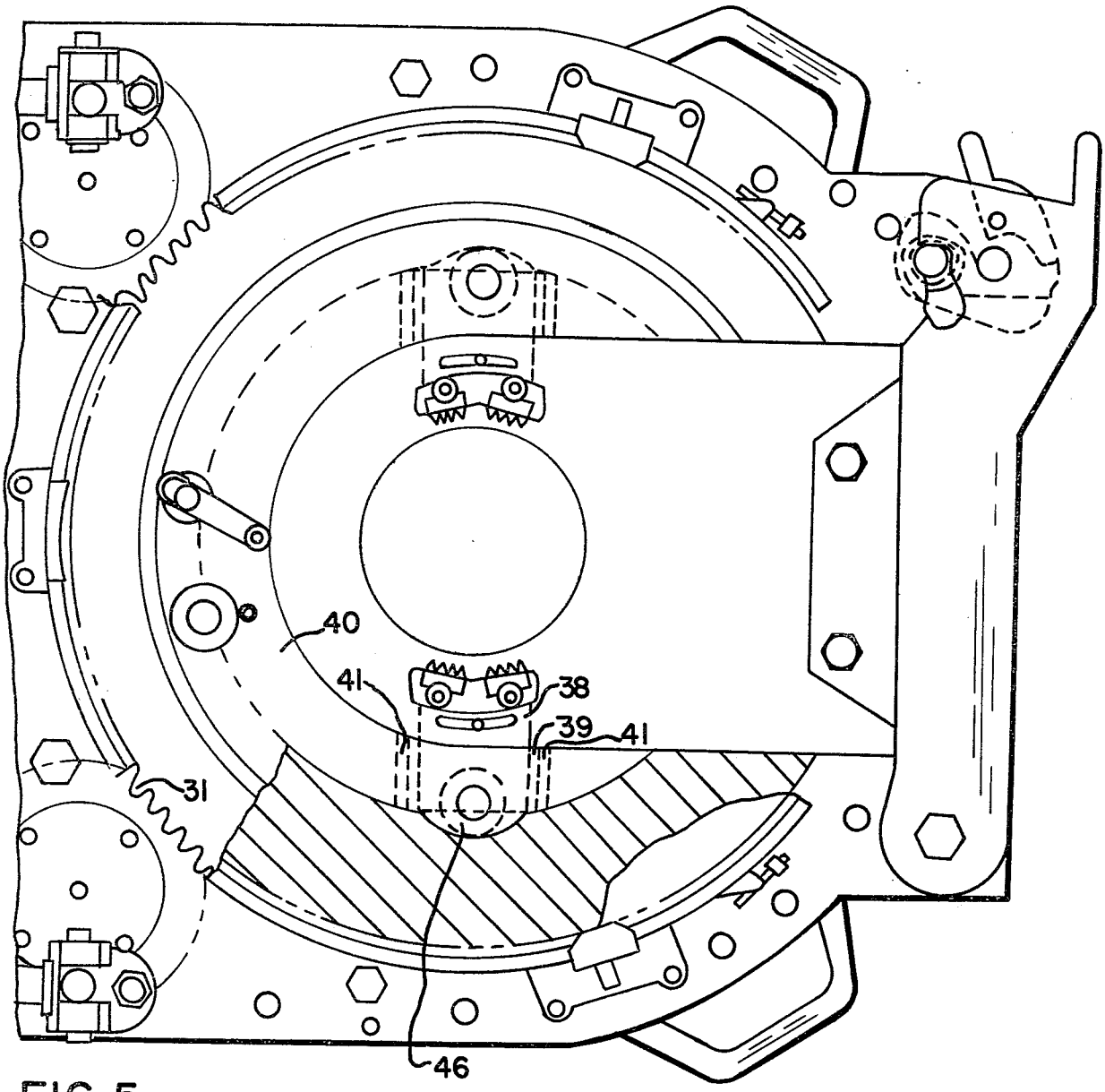
FIG. 5 shows an alternative embodiment of the invention in which a jaw assembly is slidably mounted in radial interstices of the drag assembly.

The drag assembly 34 (sometimes called a drag drum or carrier member) is comprised of two generally annular plate members 34A and 34B (hereafter referred to as 34) connected in a parallel fashion and is rotatably mounted within the housing 23 along the same axis of rotation of the rotor 27. The drag assembly 34 also has a throat or opening 48 to align with the throat 47 in the rotor 27 to allow insertion of the axially elongated body 26. Although the preferred embodiment comprises two plate members bolted together in a sandwich or parallel fashion, one substantial disc shaped member could be used. In a preferred embodiment the jaw assembly 1 is sandwiched between the two plate members and is pivotally connected to both plate members with a bolt which fits in an aperture 11. In the alternate embodiment as shown in FIG. 4 a drag assembly 35 is pivotally connected to a lever arm 36 and the lever arm 36 is also pivotally connected to a jaw assembly 37. In the alternative embodiment shown in FIG. 5 a jaw assembly 38 is placed within radial interstice 39 of a drag assembly 40. As shown in FIG. 5 the radial interstice is formed by two wall pieces 41 parallel to each other, attached perpendicular to the plane defined by the plate members and sandwiched between the plate members forming a box or radial interstice for the jaw assembly 38 to be slidably mounted into.

Figure 2:
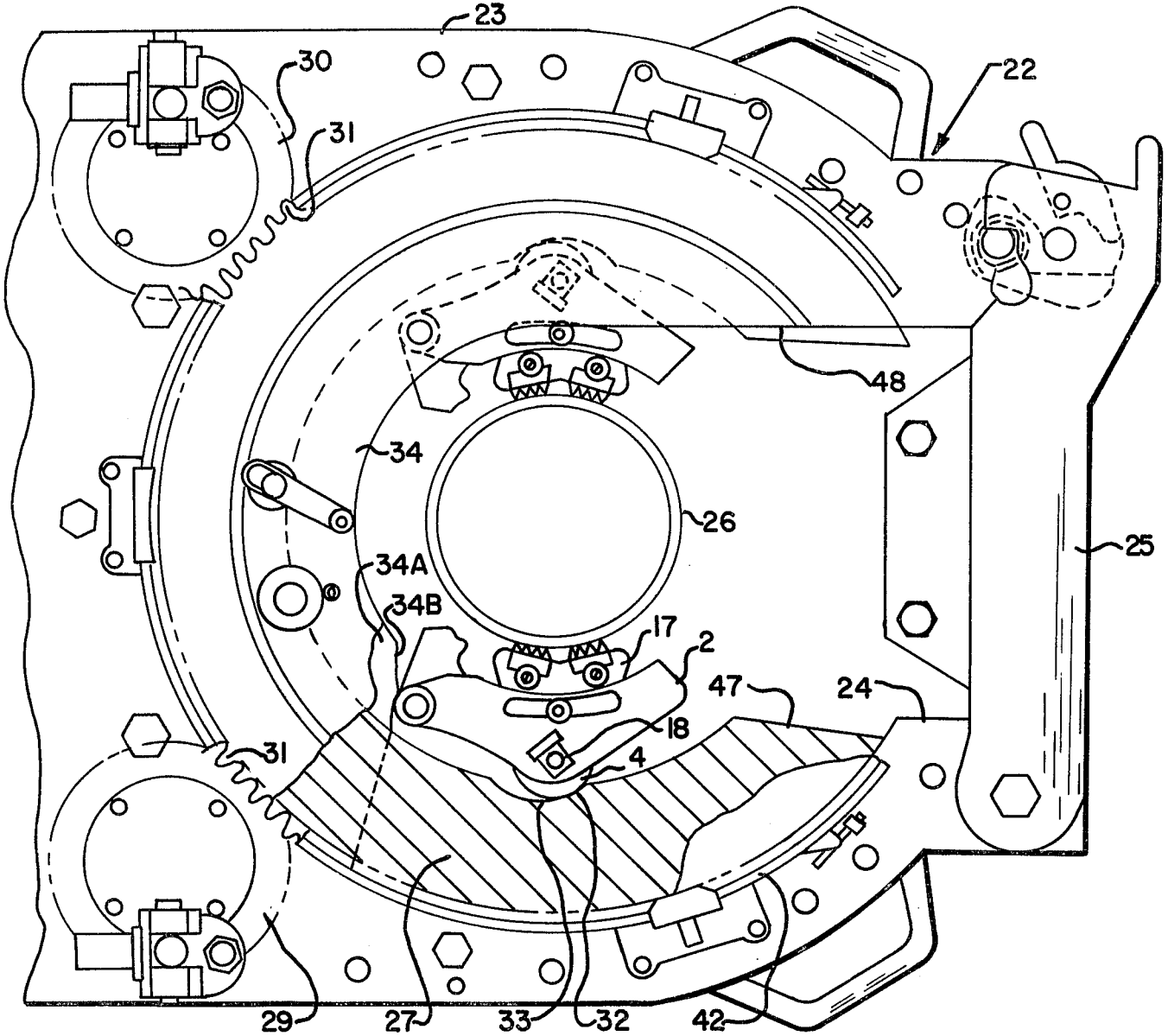
FIGS. 2 and 3 show operation of the tong illustrated in FIG. 7.
Figure 3:
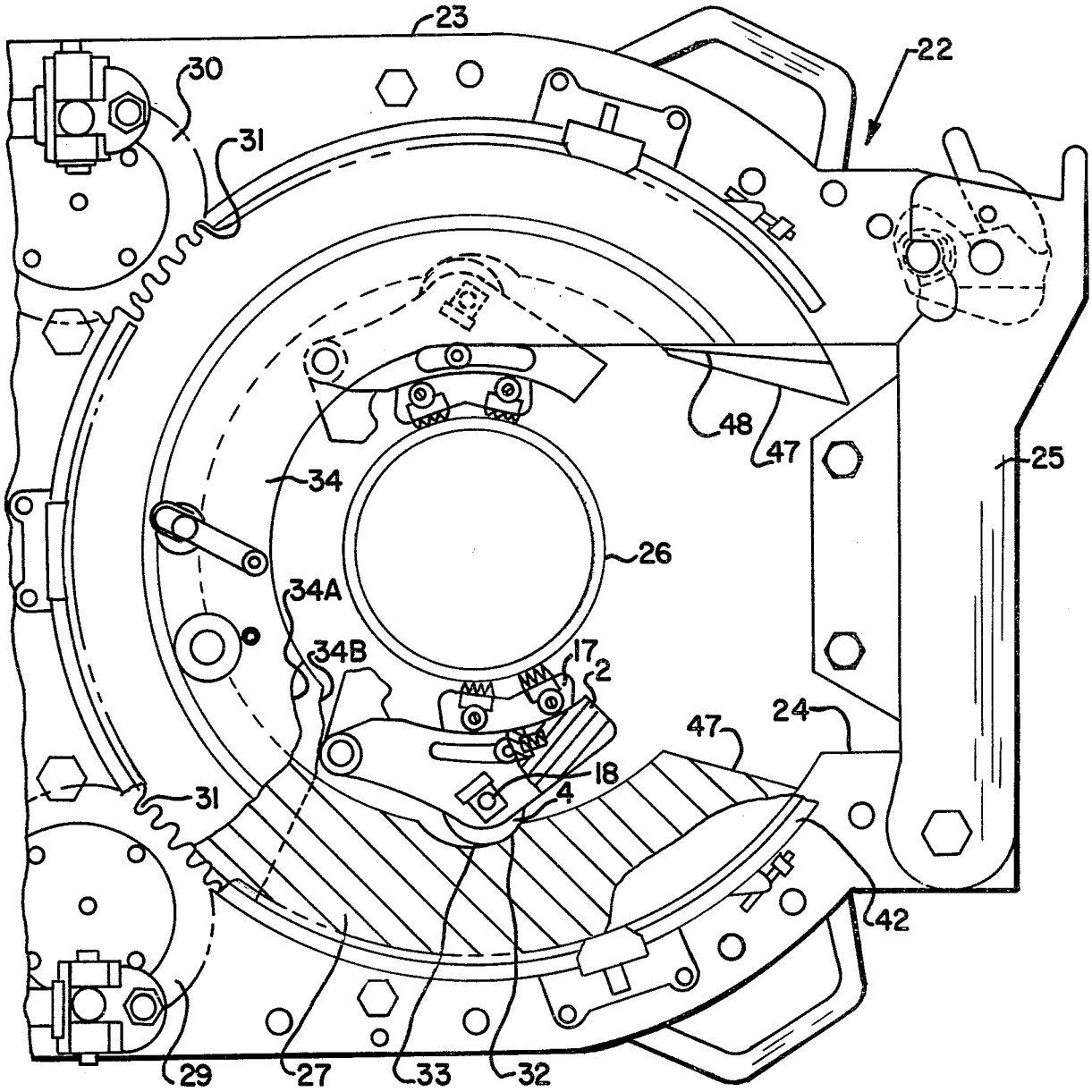

Further regarding operation of the tong 22, in FIG. 2 we see the rotor 27 has been rotated in a clockwise direction through cooperation among the gear teeth 31 and the pinion gears 29 and 30, thus causing the cam surface 32 to push against the cam surface contact member 4. As the cam surface contact member 4 becomes locked against the cam surface 32 the jaw frame 2 is pivotally pushed radially inward engaging the die inserts 6 of the die assembly 17. As the rotor 27 continues to rotate in a clockwise direction relative motion between the jaw frame 2 and the die assembly 17 occurs and the die assembly 17 moves in a counterclockwise direction relative to the jaw frame 2 causing a second camming action. The second camming action is limited by the tongue 10 hitting the landing 16. As the rotor 27 continues to turn with the jaw frame 2 and die assembly 17 engaged a friction means 42 is released or overcome allowing the drag assembly 34 to rotate with the jaw assembly 1, axially elongated body 26 and rotor 27.

The preferred embodiment shown in FIG. 4 works in the same manner as the aforementioned preferred embodiment except that a cam surface contact member 45 pushes the lever arm 36 which then pushes the jaw frame 37 pivotally inward. The preferred embodiment shown in FIG. 5 works in the same manner as the preferred embodiment described previously except that a cam surface 46 contact member pushes the jaw frame 38 radially inward instead of pivotally inward as in the other preferred embodiment.

Although the invention has been shown in connection with specific embodiments, it will be readily apparent to those skilled in the art that various changes in form and arrangement of parts may be made to suit requirements without departing from the spirit and scope of this invention.

I claim:

1. A jaw assembly for use in a power tong for axially rotating an axially elongated body which comprises:

a jaw frame carried by the power tong for movement into and out of engagement with said axially elongated body;

a cam follower means connected to said jaw frame and adapted to cooperate with a cam surface portion of said power tong to impart a primary camming action of the jaw frame into and out of engagement with said axially elongated body, and;

a die assembly slidably mounted to said jaw frame allowing relative motion between itself and said jaw frame in at least two directions along a camming surface of contact with said jaw frame and cooperating with said jaw frame providing a second camming action which radially increases the force of said die assembly against the axially elongated body independently of the primary camming action of the jaw frame upon engagement with said body and said relative motion in either of said at least two directions.

2. A jaw assembly as recited in claim 1 wherein said cam follower means is comprised of a cam surface contact member which is rotatably connected to said jaw frame.

3. A jaw assembly as recited in claim 1 wherein said camming surface of contact between said die assembly and said jaw frame is a curvature with a radius smaller than the radius of the axially elongated body to be axially rotated.

4. A jaw assembly as recited in claim 3 wherein said camming surface of contact is a circular curvature.

5. A jaw assembly as recited in claim 1 wherein said die assembly includes a die holder and a detachable die insert.

6. A jaw assembly as recited in claim 1 wherein said die assembly has a tongue portion which fits within a groove of said jaw frame.

7. A jaw assembly as recited in claim 6 wherein said jaw frame includes upper and lower side portions to form said groove and said tongue is retained in said groove by means of a pin which connects with said tongue and is allowed to slide within crescent shaped slots formed within said jaw frame upper and lower side portions.

8. A jaw assembly as recited in claims 1 or 6 including stopping means to limit the relative motion between said die assembly and said jaw frame.

9. A jaw assembly as recited in claims 1 or 6 further including biasing means to urge said die assembly into a neutral position in relation with said jaw frame.

10. A jaw assembly as recited in claim 9 wherein said biasing means is a coil spring captured between said die assembly and said jaw frame.

11. A jaw assembly as recited in claim 1 wherein said cam follower means includes a lever arm pivotally connected to said jaw frame and a cam surface contact member rigidly attached to said lever arm opposite said jaw frame.

12. A jaw assembly as recited in claim 1 wherein said cam follower means includes a lever arm pivotally connected to said jaw frame and a cam surface contact member which is rotatably connected to said lever arm opposite said jaw frame.

13. A jaw assembly as recited in claim 1 which further includes mounting means for mounting said jaw assembly to a drag assembly of the power tong.

14. A jaw assembly as recited in claim 13 wherein said mounting means include means for pivotally connecting said jaw frame to said drag assembly.

15. A jaw assembly as recited in claim 13 wherein said mounting means includes a lever arm pivotally connected to said jaw frame, said lever arm pivotally connected to said drag assembly.

16. A jaw assembly as recited in claim 15 wherein said lever arm is also connected to said cam surface contact member.

17. A jaw assembly as recited in claim 13 wherein said mounting means includes means for slidably mounting said jaw frame within a radial interstice of the drag assembly.

18. A jaw assembly for use in a power tong for axially rotating an axially elongated body which comprises:

a jaw frame carried by the power tong for movement into and out of engagement with said elongated body, said jaw frame including a main body portion, an upper and a lower side portion, said upper and lower side portions generally formed in the shape of a plate extending from the main body portions and forming a groove between said side portions, said upper and lower side portions having crescent shape slots, said crescent shaped slots being in alignment with each other in a direction generally perpendicular to said groove formed between said upper and lower side portions;

a cam follower means connected to said jaw frame and adapted to cooperate with a cam surface portion of said power tong to impart a primary camming movement of the jaw frame into and out includes a coil spring captured between said tongue and said jaw frame and another coil spring captured between said tongue and said jaw frame opposite the first mentioned coil spring and;

mounting means for mounting said jaw assembly to a drag assembly of a power tong.

19. A power tong for axially rotating an axially elongated body which comprises;

a housing;

a generally annular rotor carried by said housing and rotatable relative to said housing about an axis extending generally perpendicular to the opposite sides of said housing;

a cam surface formed on the inner periphery of said annular rotor;

drive means carried by said housing for rotating said rotor;

a generally annular disc drag assembly which is carried by said housing and is rotatable relative to said housing about an axis extending generally perpendicular to the opposite sides of said housing and is also rotatable relative to the annular rotor;

a plurality of jaw assemblies wherein at least one jaw assembly includes a jaw frame carried by said power tong for movement into and out of engagement with an axially elongated body, a cam follower means connected to said jaw frame and adapted to cooperate with said cam surface of said power tong to impart a primary camming action of the jaw frame into and out of engagement with said axially elongated body, a die assembly slidably mounted to said jaw frame allowing relative motion between itself and said jaw frame in at least two directions along a camming surface of contact with said jaw frame and cooperating with said jaw frame providing a second camming action which radially increases the force of said die assembly against the axially elongated body independently of the primary camming action of the jaw frame upon engagement with said body and said relative motion in either of said at least two directions, mounting means for mounting said jaw frame to said drag assembly; and a friction means for restraining rotation of said drag assembly.

20. A power tong as recited in claim 19 wherein there are at least two cam surfaces formed on diametrically-opposite sides of the inner periphery of said annular rotor and wherein at least two of said jaw assemblies include a jaw frame carried by said power tong for movement into and out of engagement with an axially elongated body, and a cam follower means connected to said jaw frame and adapted to cooperate with said diametrically-opposite cam surfaces of said power tong to impart a primary camming action of the jaw frame into and out of engagement with said axially elongated body.

21. A power tong for axially rotating an axially elongated body which comprises:

a housing with a throat for receiving an axially elongated body;

a generally annular rotor carried by said housing and rotatable relative to said housing about an axis extending generally perpendicular to the opposite sides of said housing and having a rotor opening therein which is adapted to be aligned with said throat so that said axially elongated body may be positioned within said annular rotor;

cam surfaces formed on diametrically-opposite sides of the inner periphery of said annular rotor;

drive means carried by said housing for rotating said annular rotor;

a generally annular drag assembly comprised of two plate members connected in a parallel fashion by bolts, said drag assembly being carried by said housing about an axis extending generally perpendicular to the opposite sides of said housing and also being rotatable relative to said annular rotor and having a drag assembly opening therein which is adapted to be aligned with said throat so that said axially elongated body may be positioned within said drag assembly;

a plurality of jaw assemblies each including a jaw frame carried by said power tong for movement into and out of engagement with said elongated body, said jaw frame including a main body portion, an upper and lower side portion, said upper and lower side portions generally formed in the shape of a plate extending from the main body portion and forming a groove between said upper and lower side portions, said upper and lower side portions each having a crescent shaped slot, said crescent shaped slots being in alignment with each other in a direction generally perpendicular to said groove, cam follower means connected to said jaw frame and adapted to cooperate with a cam surface portion of such a power tong to impart a primary camming movement of the jaw frame into and out of engagement with said elongated body and said cam follower means including a rotatably mounted circular cam surface contact member, a die assembly slidably mounted to said jaw frame allowing relative motion between itself and said jaw frame along a camming circular curvature surface of contact of said jaw frame and cooperating with said jaw frame providing a second camming action which radially increases the force of said die assembly against the axially elongated body, said camming circular curvature surface of contact having a radius smaller than the radius of the axially elongated body to be rotated and the focus of said circular curvature surface of contact being located such that when said jaw assembly is engaged upon said elongated body, relative motion in either direction betwen said jaw frame and said die assembly results in a second camming action which increases the force of said die assembly against said body, said die assembly including a tongue which slides within said groove and connects with a pin, said pin being retained within said crescent slots of said upper and lower side portions, stopping means for limiting relative motion between said jaw frame and said die assembly, biasing means to urge said die assembly into a neutral position in relation with said jaw frame, said biasing means including a coil spring captured between said tongue and said jaw frame and another coil spring captured between said tongue and said jaw frame opposite the first mentioned coil spring, mounting means for mounting said jaw assembly to a drag assembly of said power tong; and a friction means for restraining rotation of said drag assembly.

22. A power tong as recited in claims 19, 20 or 21 wherein said mounting means includes means for pivotally connecting said jaw frame to said drag assembly.

23. A power tong as recited in claims 19, 20 or 21 wherein said mounting means includes means for slidably mounting said jaw frame within a radial interstice of the drag assembly.

24. A power tong as recited in claims 19, 20 or 21 wherein said mounting means includes a lever arm pivotally connected to said jaw frame, said lever arm also being pivotally connected to said drag assembly.

25. A power tong as recited in claims 19, 20 or 21 wherein the cam follower means includes a lever arm pivotally attached to said jaw frame and a cam surface contact member connected to said lever arm.

* * * * *

UNITED STATES PATENT AND TRADEMARK OFFICE

CERTIFICATE OF CORRECTION

PATENT NO. : 4,437,363

DATED : March 20, 1984

INVENTOR(S) : Charles W. Haynes

It is certified that error appears in the above-identified patent and that said Letters Patent is hereby corrected as shown below:

Column 7, line 1, after the words "into and out" insert the following:

-- of engagement with said elongated body and said cam follower means including a rotatably mounted circular cam surface contact member;

a die assembly slidably mounted to said jaw frame allowing relative motion between itself and said jaw frame along a camming circular curvature surface of contact of said jaw frame in at least two directions and cooperating with said jaw frame providing a second camming action which radially increases the force of said die assembly against the axially elongated body independently of the primary camming action of the jaw frame upon engagement with said body and said relative motion in either of said at least two directions, said camming circular curvature surface of contact having a radius smaller than the radius of the axially elongated body to be axially rotated and the focus of said circular curvature surface of contact being located such that upon said jaw assembly engaging said axially elongated body, relative motion in either direction between said jaw frame and said die assembly results in a second camming action, said die assembly including a tongue which slides within said groove and which

UNITED STATES PATENT AND TRADEMARK OFFICE

CERTIFICATE OF CORRECTION

PATENT NO. : 4,437,363

DATED : March 20, 1984

INVENTOR(S) : Charles W. Haynes

It is certified that error appears in the above-identified patent and that said Letters Patent is hereby corrected as shown below:

connects with a pin, said pin being retained within said crescent slots of said upper and lower side portions;

stopping means for limiting relative motion between said jaw assembly and said die frame;

biasing means for urging said die assembly into a neutral position in relation with said jaw frame which --

Signed and Sealed this

*Eighth* Day of *January 1985*

[SEAL]

*Attest:*

*Attesting Officer*

GERALD J. MOSSINGHOFF

*Commissioner of Patents and Trademarks*